US007441358B1

(12) United States Patent
Ngan

(10) Patent No.: US 7,441,358 B1
(45) Date of Patent: Oct. 28, 2008

(54) MAGNETIC ARTICLE DISPLAY FRAME EASEL

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 0 days.

(21) Appl. No.: 11/826,505

(22) Filed: Jul. 16, 2007

(51) Int. Cl.
*G09F 7/00* (2006.01)

(52) U.S. Cl. ..... 40/610; 281/33

(58) Field of Classification Search ..... 248/441.1, 248/450, 455, 460, 463, 462, 459; 40/775, 40/610, 124.06; 116/63 P, 63 T; 281/33
See application file for complete search history.

(56) References Cited

U.S. PATENT DOCUMENTS

| | | | | | |
|---|---|---|---|---|---|
| 91,728 | A * | 6/1869 | Eastman | 40/774 |
| 386,874 | A * | 7/1888 | Folt | 40/775 |
| 1,368,859 | A * | 2/1921 | Styll | 248/459 |
| 2,281,054 | A | 4/1942 | Smith et al. | |
| 2,975,539 | A | 3/1961 | Anderson | |
| 3,039,227 | A * | 6/1962 | Buchholtz | 248/452 |
| 3,471,958 | A * | 10/1969 | Westin | 40/592 |
| 3,616,558 | A | 11/1971 | Jahn | |
| 5,413,305 | A * | 5/1995 | Leeb | 248/460 |
| 5,784,814 | A | 7/1998 | Capehart | |
| 5,918,400 | A | 7/1999 | Schonberger | |
| 6,427,371 | B2 * | 8/2002 | Olson et al. | 40/789 |
| 6,651,367 | B1 * | 11/2003 | Barragan | 40/610 |
| 6,746,051 | B1 * | 6/2004 | Archie et al. | 283/56 |
| 7,287,751 | B2 * | 10/2007 | Webber, Jr. | 273/239 |

* cited by examiner

*Primary Examiner*—Cassandra Davis
(74) *Attorney, Agent, or Firm*—Shlesinger, Arkwright & Garvey LLP.

(57) ABSTRACT

A magnetic article display frame easel having five hinged panels in which the panels have a first abutting position, a second easel position and a third open-in-line position and in which the display frame can be magnetically locked in easel position or magnetically positioned on a magnet attracting wall such as a refrigerator or cabinet.

16 Claims, 6 Drawing Sheets

MAGNETIC ARTICLE DISPLAY FRAME EASEL

FIELD OF THE INVENTION

This invention relates to a magnetic article display frame easel which can be converted to a wall mounting device which may include windows on the front and rear of the easel.

BACKGROUND OF THE INVENTION

Wall mounted picture or calendar holders of a frame type are well known as illustrated in Smith et al. U.S. Pat. No. 2,281,054.

Various easel display devices such as Anderson U.S. Pat. No. 2,975,539, Jahn U.S. Pat. No. 3,616,558, Capehart U.S. Pat. No. 5,784,814 and Schonberger U.S. Pat. No. 5,918,400 show frame devices. Magnetic means associated therewith are shown for example in Anderson, Capehart and Schonberger.

Capehart in particular shows an easel type development which can be hung vertically on a wall by magnetic means.

OBJECTS AND SUMMARY OF THE INVENTION

It is an object of this invention to provide a magnetic article display frame easel which is attractive and inexpensive to manufacture and which may be provided with windows in the front and rear when set up as an easel.

A further object of this invention is to provide a magnetic article display frame easel which is provided with a magnetic locking flap to prevent collapse of the easel if bumped or disturbed.

A further object of this invention is to provide a magnetic article display frame easel which can be opened up and linearly positioned on a magnetic attracting surface such as a wall of a cabinet or a refrigerator or the like.

Yet another object of this invention is to provide a magnetic article display frame easel which is collapsible for storing and shipping purposes.

Another object of this invention is to provide an article display frame easel which may have one or more pockets for holding display articles in proper position in a window or windows provided in the frame.

Yet still a further object of this invention is to provide a magnetic article display frame easel which is sturdy and rigid and which avoids collapsing on an accidental hitting or bumping.

In summary, this invention relates to a magnetic article display frame easel which can be easily erected for easel display or which can be mounted vertically on a magnetic attracting wall surface. These and other objects of this invention will be apparent from the following description and drawings which are as follows:

BRIEF DESCRIPTION OF THE DRAWINGS

FIGS. 1 THROUGH 3

In FIGS. 1 through 3, the invention is shown as a frame easel F having windows W which may be on the front and the back as illustrated though it is possible to have a window or windows W on one side only as desired. Pockets P are formed by backs 2 and 4 and may be of stiff material such as paper stock. The frame easel F consists of first panel 6, second panel 8, third panel 10, fourth panel 12, and fifth panel 14. Horizontal hinge 16 connects panels 6 and 8. Horizontal panel 18 connects panels 8 and 10. Horizontal hinge 20 connects panels 10 and 12 and horizontal hinge 22 connects panels 12 and 14. The panels 6, 8, 10, 12, and 14 are interconnected by hinges 16, 18, 20 and 22. As shown in FIGS. 2 and 3, magnets M are positioned in the flap or first panel 6 to engage with a magnetic or magnetically attracting device MA to maintain the first panel 6 against the fifth panel 14 when the frame F is in easel position. It is obvious that the magnetically attracting device MA can be another magnetic polarized in the same direction as magnetic M. It is also obvious that magnet M could be a magnetic attracting device in the reverse position of the magnet M and the magnetic attracting device MA as illustrated. The pocket or pockets P may include a thumb hole 24 for ease in opening for insertion or removal of an article A to be displayed. It is further obvious that small circular magnets M or magnetic attracting device MA could be individual strip magnets or single magnets rather than multiples depending upon the force of the magnetic field. It should be noted that the pocket or pockets P are shorter in length than the second 8 and fifth panels 14.

FIG. 5

In FIG. 5, a dress cover 26 is provided and may be of plastic, leather or the like. Positioned on the dress cover prior to full assembly are stiff board inserts 28, 30, 32, 34 and 36 which form the panels 6, 8, 10, 12 and 14.

FIGS. 6, 7 AND 8

FIGS. 6 and 7 show the in-line view of the display frame F from the front as well as from the back. The pockets P are sealed to the panels 2 and 5 on the sides 38, 40, 42, 44, 46 and 48. The top of the pockets P are open for insertions of items or material A which is viewed through the windows W. As best illustrated in FIG. 7, a cosmetic sheet 50 is provided to enhance the inside appearance of the frame F and may be of calendered board cellulose material or the like. As further illustrated in FIG. 8, the lower pocket P may be reversed to be opened in the same direction as the upper pocket P. This will be particularly favorable if the item A is to be displayed on a wall surface. The magnets M and magnetic attracting MA devices would be sufficient to hold the frame F in a vertical position.

Figure 2:
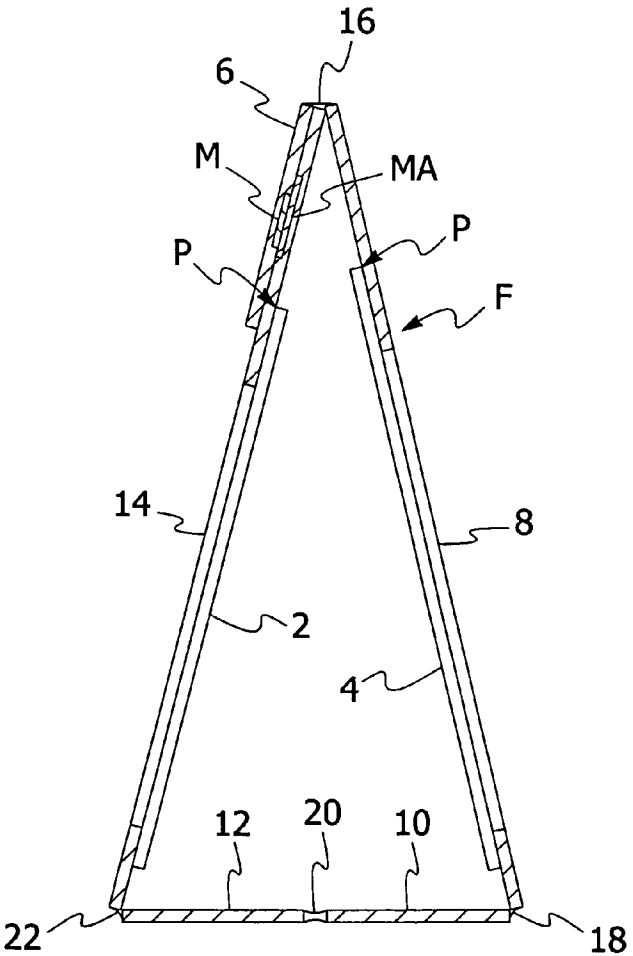
FIG. 2 is a side elevational view of the invention shown in FIG. 1.
Figure 1:
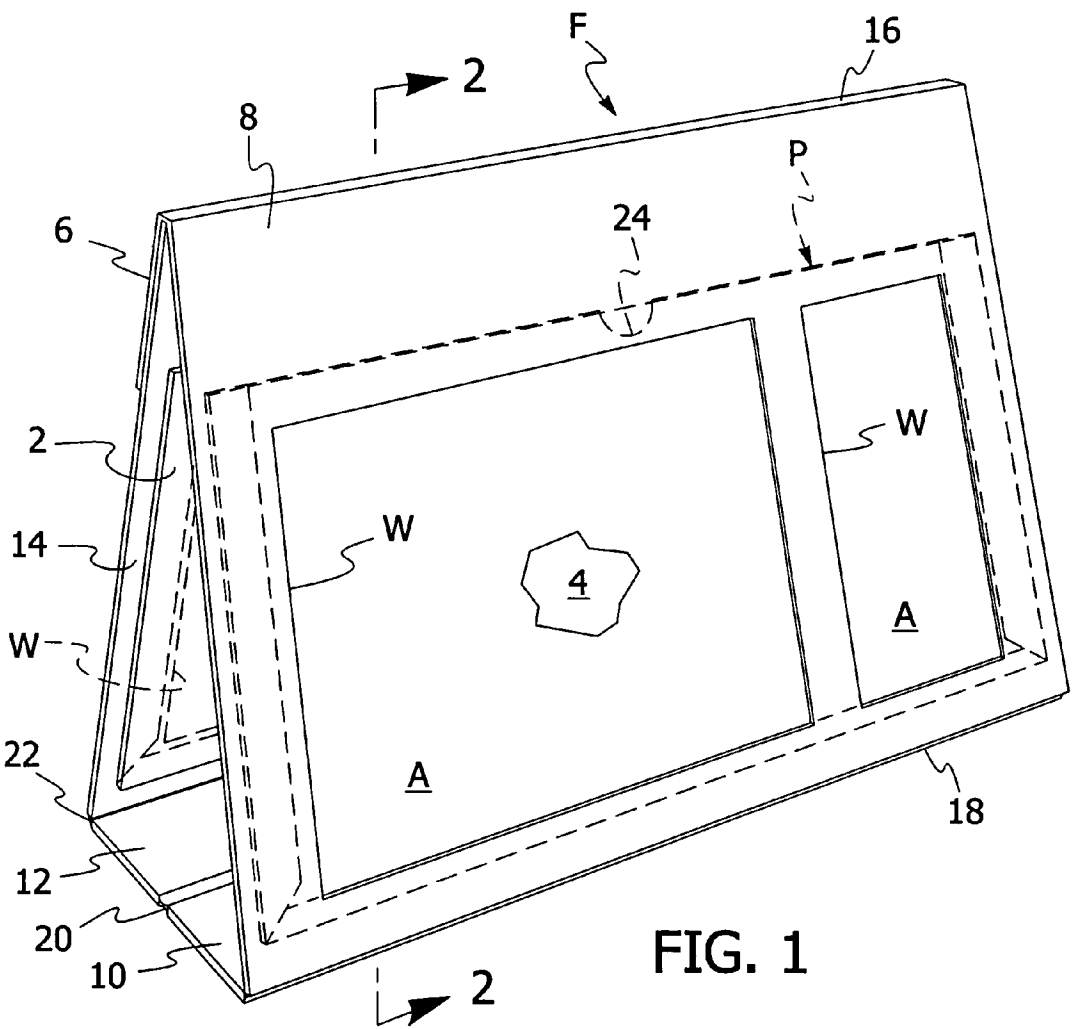
FIG. 1 is a front perspective view of the invention with portions shown in phantom lines.
Figure 3:
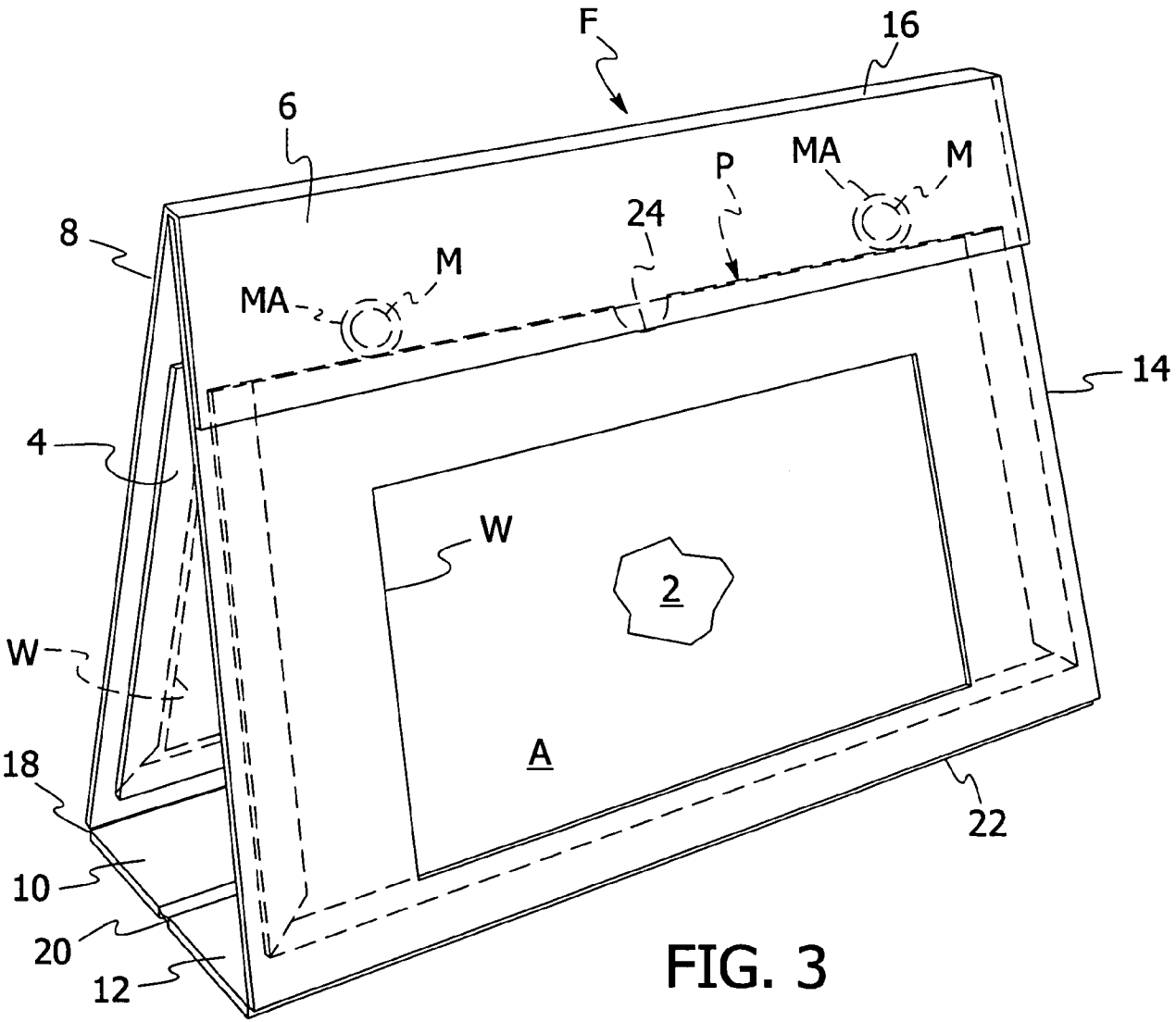
FIG. 3 is a rear perspective view of the invention with portions shown in phantom lines.
Figure 8:
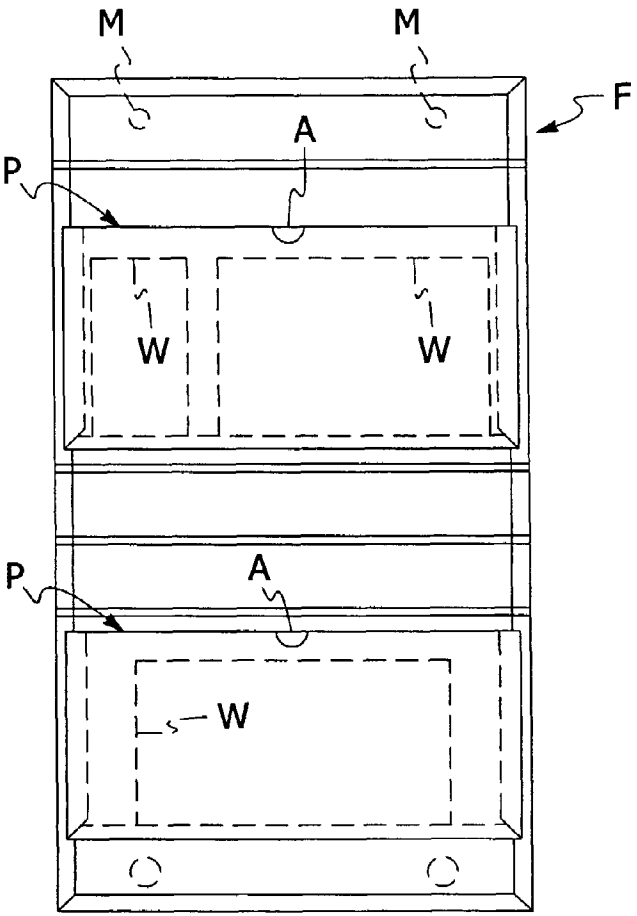
FIG. 8 is a bottom plan view of a modification of the invention portions shown in phantom lines.
Figure 4:
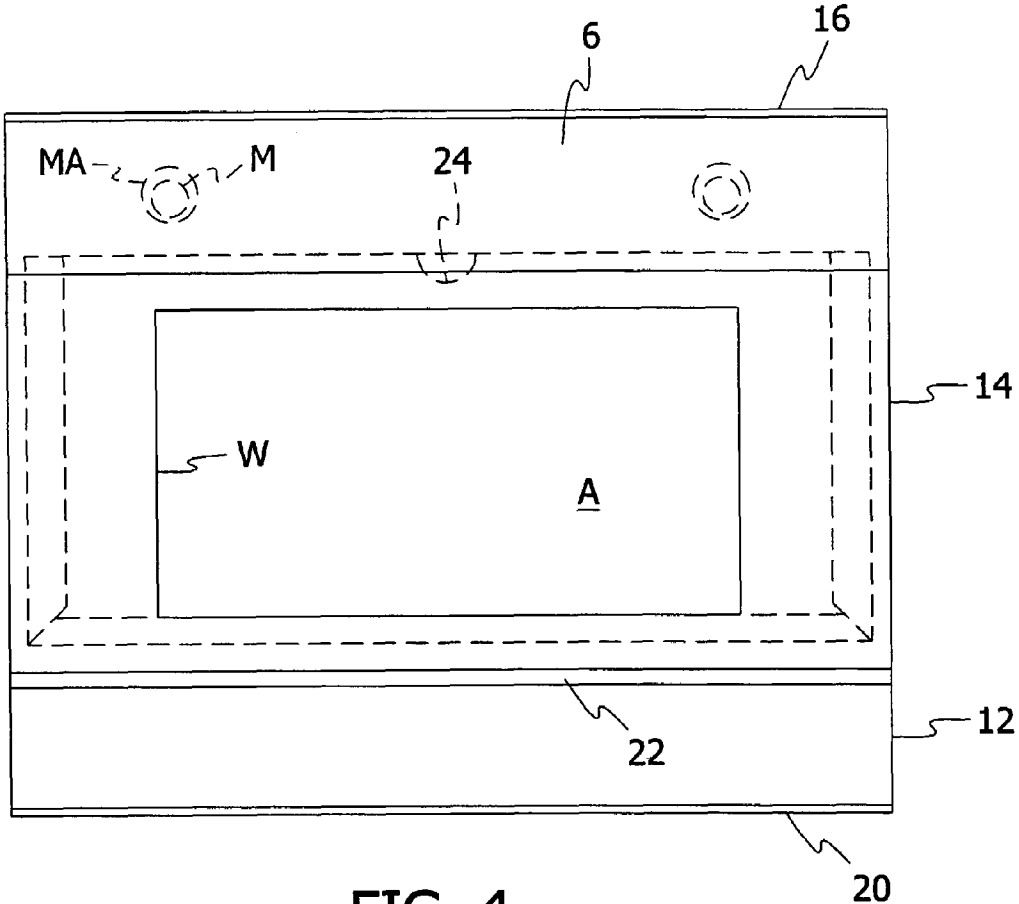
FIG. 4 is a bottom plan view of the invention when the easel is collapsed portions shown in phantom lines.
Figure 5:
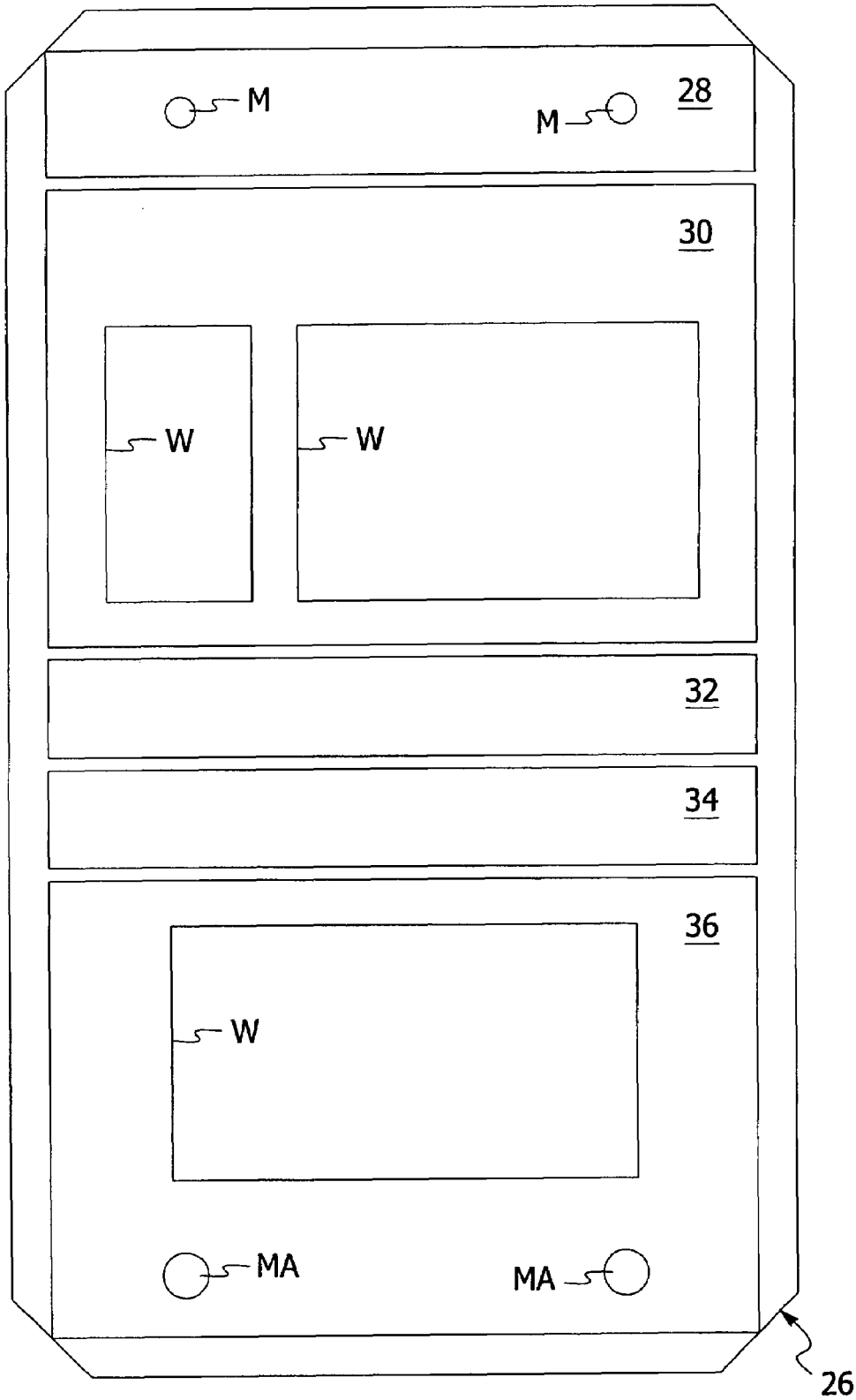
FIG. 5 is a top plan view of the initial assembly of the panels on the front wall dress cover.
Figure 6:
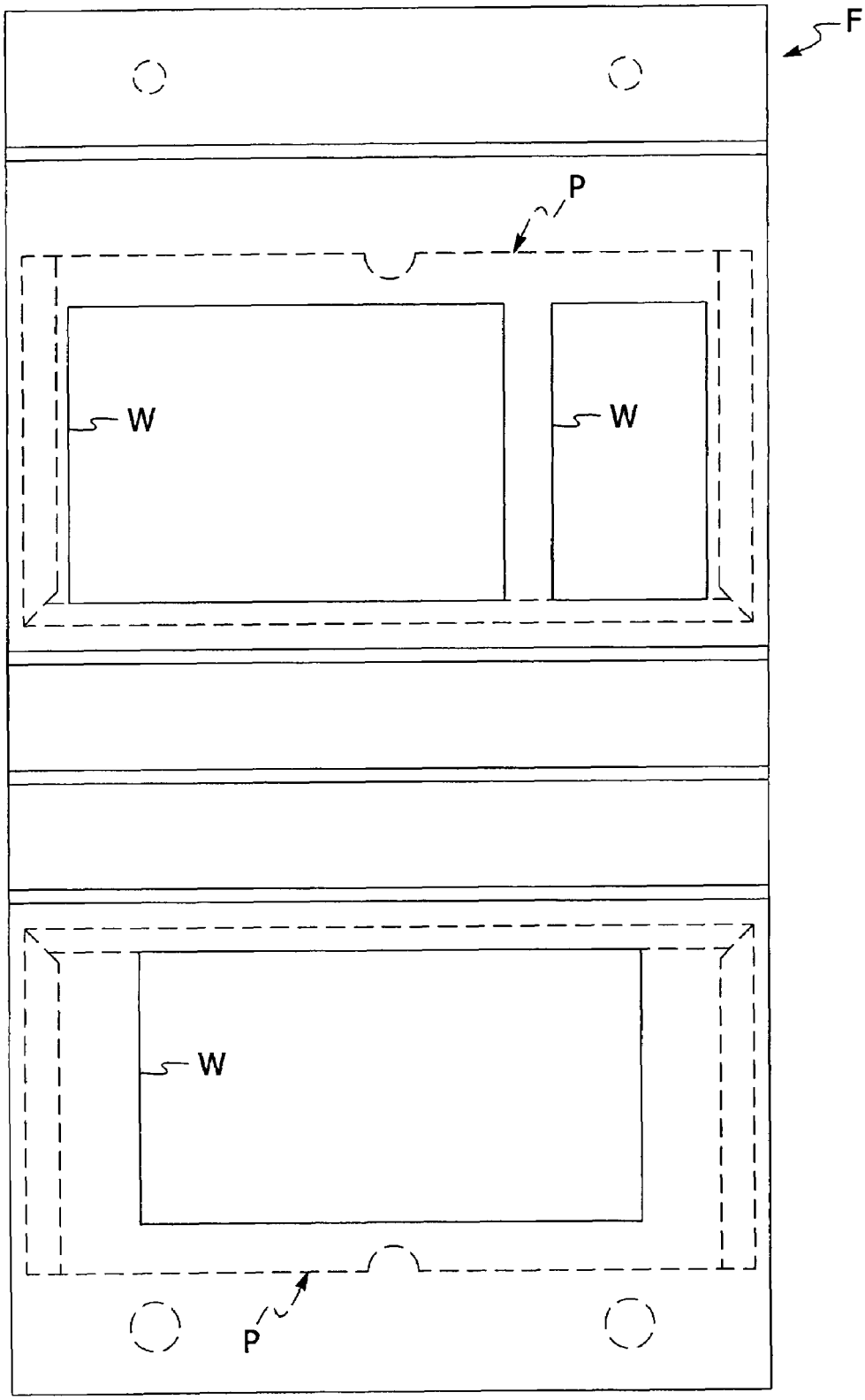
FIG. 6 is a front top plan view of the invention portions shown in phantom lines.
Figure 7:
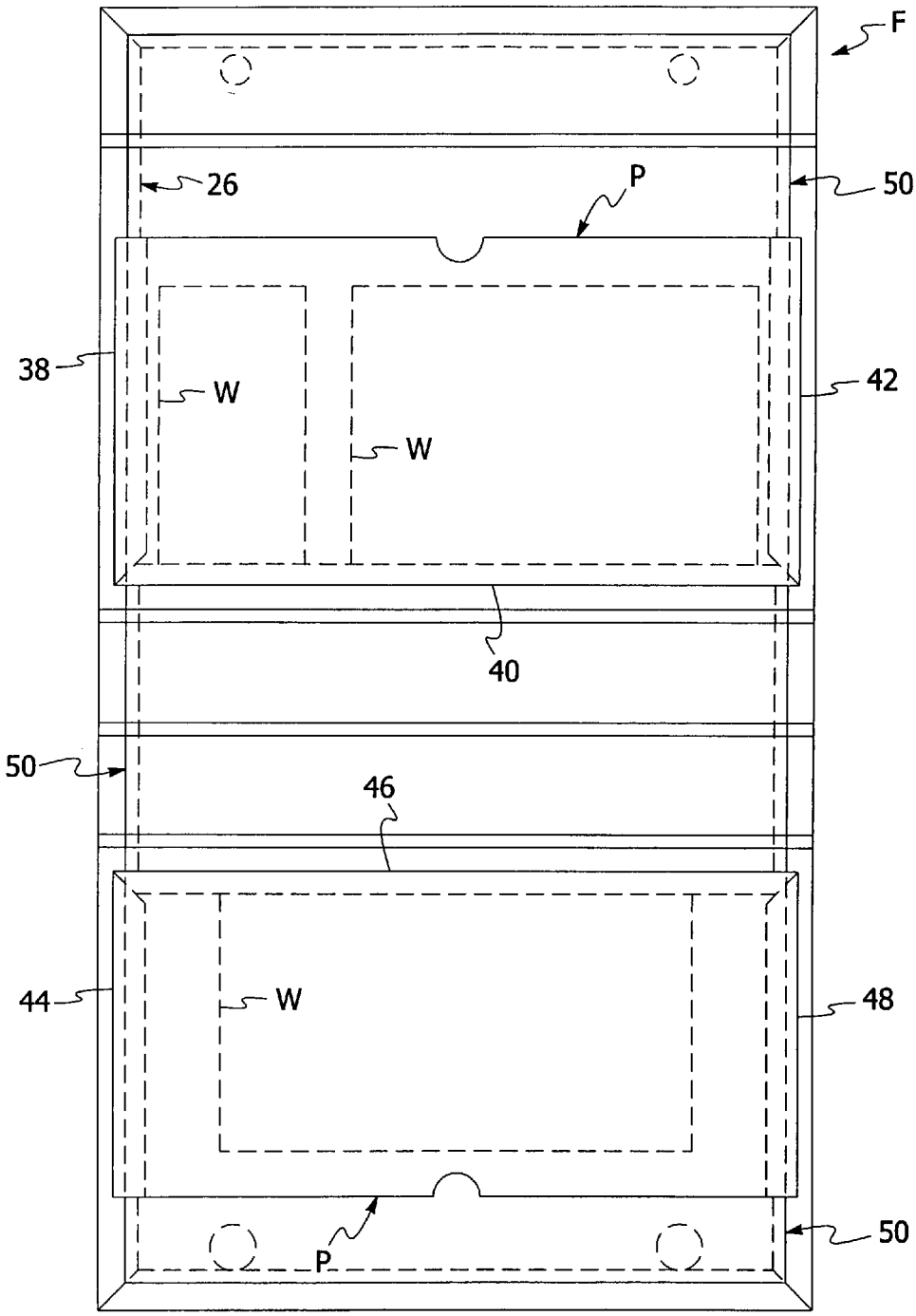
FIG. 7 is a bottom plan view of the invention; portions shown in phantom lines.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A magnetic article display frame easel comprising:

a) first, second, third, fourth and fifth panels;

b) said first and second, second and third, third and fourth, fourth and fifth panels, each having an interconnecting hinge;

c) each of said panels having a front and rear wall and top, bottom and side edges;

d) said interconnecting hinges parallel to each other and to said panels' top and bottom edges;

e) at least one of said second and fifth panels having a rear wall article receiving pocket;

f) at least one of said second and fifth panels having a window;

g) said article receiving pocket of said at least one of said second and fifth panels encompassing said at least one of said second and fifth panels' windows;

h) said first panel having at least one magnetic device;

i) said fifth panel having at least one magnetic device oriented to be positioned in proximity with said first panel's at least one magnetic device when said first panel's rear wall is hingedly positioned on said fifth panels' front wall;

j) said second and third panels having a first abutting position, a second easel position and a third open-in-line position;

k) said first abutting position having each of said panels in parallel relation with each other with said first, second and fifth panels overlying each other and said third and fourth panels overlying each other;

l) said second easel position having said first and fifth panels parallel and overlying each other, said first, second and fifth panels forming an acute angle and said third and fourth panels being in-line with each other and said second, third, fourth and fifth panels forming an acute angle; and m) said third open-in-line position having all of said panels lying in the same plane.

2. A magnetic display frame as in claim 1, and wherein:

a) said first panel's at least one magnetic device is a magnet and said fifth panel's at least one magnetic device is a magnet attracting device.

3. A magnetic display frame as in claim 1, and wherein:

a) said rear wall article receiving pocket includes a back having top, bottom and side edges having said bottom and side edges secured to said second panel's rear wall.

4. A magnetic display frame as in claim 1, and wherein:

a) said rear wall article receiving pocket includes a back having top, bottom and side edges having said bottom and side edges secured to said fifth panel's rear wall.

5. A magnetic display frame as in claim 1, and wherein:

a) said second and fifth panels each have an article receiving pocket.

6. A magnetic display frame as in claim 1, and wherein;

a) said panels have a front wall dress cover.

7. A magnetic display frame as in claim 6, and wherein:

a) said panels have a rear wall cosmetic cover.

8. A magnetic display frame as in claim 6, and wherein:

a) said dress cover is plastic.

9. A magnetic display frame as in claim 7, and wherein:

a) said cosmetic cover is cellulose material.

10. A magnetic display frame as in claim 1, and wherein:

a) said panels each include stiff cardboard inserts.

11. A magnetic display frame as in claim 3, and wherein:

a) said at least one article receiving pocket back is a stiff calendered paper stock.

12. A magnetic display frame as in claim 1, and wherein:

a) said rear wall article receiving pocket includes a thumb hole for ease in inserting and removing an article to be displayed.

13. A magnetic display frame as in claim 5, and wherein:

a) said second and fifth panels' article receiving pockets face in opposite directions when in said third open-in-line position.

14. A magnetic display frame as in claim 5, and wherein:

a) said second and fifth panels' article receiving pockets face in similar direction.

15. A magnetic display frame as in claim 5, and wherein:

a) said second and fifth panels' article receiving pockets are shorter in length than said second and fifth panels.

16. A magnetic display frame as in claim 1, and wherein:

a) said first panel is a locking flap.

* * * * *